US005485791A

United States Patent [19]

Lubbecke et al.

[11] Patent Number: 5,485,791

[45] Date of Patent: Jan. 23, 1996

[54] DEVICE FOR MAINTAINING A REGION OF A CONVEYOR PATH OF AN OVERHEAD CONVEYOR FREE OF CONVEYOR CARRIAGES IN THE EVENT OF AN ALARM

[75] Inventors: Udo Lubbecke, Detmold; Ralf Schneuing; Gerhard Schilling, both of Bielefeld, all of Germany

[73] Assignee: Dürkopp Adler Aktiengesellschaft, Germany

[21] Appl. No.: 194,488

[22] Filed: Feb. 10, 1994

[30] Foreign Application Priority Data

Feb. 13, 1993 [DE] Germany ..... 43 04 369.0

[51] Int. Cl.[6] ..... B65G 17/00

[52] U.S. Cl. ..... 104/172.4

[58] Field of Search ..... 104/172.1, 172.4, 104/172.2, 172.3, 172.5

[56] References Cited

U.S. PATENT DOCUMENTS

| | | | |
|---|---|---|---|
| 2,943,580 | 7/1960 | Burrows | 104/172.4 |
| 2,987,012 | 6/1961 | King | 104/172.4 |
| 3,541,967 | 9/1968 | Birkhead | 104/172.4 |
| 4,070,972 | 1/1978 | Folsom et al. | 104/172.4 |
| 4,292,897 | 10/1981 | Wakabayashi | 104/172.4 |

FOREIGN PATENT DOCUMENTS

| | | | |
|---|---|---|---|
| 0261536 | 5/1963 | Australia | 104/172.4 |
| 1133313 | 7/1962 | Germany . | |
| 2063967 | 7/1971 | Germany | 104/172.4 |
| 2554272 | 2/1978 | Germany . | |

*Primary Examiner*—Mark T. Le

*Attorney, Agent, or Firm*—Ostrolenk, Faber, Gerb & Soffen

[57] ABSTRACT

A device for removing conveyor carriages from a conveyor-path region of an overhead conveyor in the event of an alarm, particularly in the region of a fire door. The overhead conveyor has a plurality of conveyor carriages received on a travel rail, a drivable pull line driven by a main drive for the conveyor carriages, and a plurality of drivers connected to the pull line, on each of which displaceable stop pawls are arranged. Within the conveyor-path region that is to remain clear, there is arranged in a fixed position a rail which acts upon the drivers as they pass the rail and in each case swings the stop pawl not in contact with the conveyor carriage into a non-driving position, so that upon the triggering of an alarm, although the overhead conveyor is stopped, a conveyor carriage present in the conveyor-path region can be moved out of conveyor-path region by an auxiliary drive which is also located in the conveyor-path region.

8 Claims, 7 Drawing Sheets

DEVICE FOR MAINTAINING A REGION OF A CONVEYOR PATH OF AN OVERHEAD CONVEYOR FREE OF CONVEYOR CARRIAGES IN THE EVENT OF AN ALARM

BACKGROUND OF THE INVENTION

1. Field of the Invention

The present invention relates to a device for maintaining a region of a conveyor path of an overhead conveyor free of conveyor carriages in the event of an alarm, particularly a region of a conveyor path region that extends through a fire door.

2. Description of the Related Art

Federal Republic of Germany 25 54 272 C2 discloses an overhead conveyor for transporting material on conveyor carriages along a conveyor path, in which conveyor carriages are conducted on a travel rail and moved by a pull chain through the working region of a fire door. In accordance with the disclosure, a trap 7 which enters into operation upon the disconnection of the overhead conveyor is provided in the region of the fire door in order to place the conveyor carriage in a condition of free travel so that it can then be moved out of the region of the fire door by an auxiliary drive which is independent of the power line.

In the known device, it is necessary to provide a control for the trap in order to be able to place the conveyor carriage in a state of free travel. Such a control has the inherent danger of an error in control, as a result of which the conveyor carriage in the free travel state can become uncontrollable. Particular danger exists if the section of the overhead path is not horizontal and, due to the suspension drive force, the conveyor carriage can move down with increasing speed over the inclined travel rail and finally strikes the adjacent conveyor carriage with greater or lesser kinetic energy.

Federal Republic of Germany AS 1 133 313 discloses a chain conveyor of an overhead system in which rail-guided trolleys can be connected via driver dogs to a conveyor chain. The driver dogs are displaceably connected to the conveyor chain and can be actuated by ramps which are arranged along the conveyor path and can be displaced into a position of rest and an operating position.

SUMMARY OF THE INVENTION

The present invention provides a device for maintaining a region of the conveyor path of an overhead conveyor free of conveyor carriages in the event of a fire alarm, with which safe operation is assured even in the case of faulty switching, and damage to the overhead conveyor is avoided.

This is achieved by providing an auxiliary drive in the region to be cleared, which is disposed for engaging any conveyor carriage that is present in that region upon the occurrence of an alarm, and for bringing the carriage out of the region.

Thus the invention provides an overhead conveyor with an arrangement for clearing conveyor carriages from a predetermined region of a travel rail in the event of an alarm, the overhead conveyor comprising a plurality of conveyor carriages, received on the travel rail, for travelling along the overhead conveyor; a drivable pull line associated with the travel rail and driven by a main drive for driving the conveyor carriages; a plurality of drivers connected to the pull line, each driver having at least one stop pawl which has an operating position in which the stop pawl is disposed for contacting and driving the conveyor carriages along the travel rail, and a non-driving position for being moved by the pull line past the conveyor carriages without driving the conveyor carriages; a rail fixed in position in the region to be cleared of conveyor carriages for engaging and placing each stop pawl which is not in contact with a conveyor carriage into its non-driving position; and an auxiliary drive in that region, which is disposed for engaging any conveyor carriage which is present in the region upon the occurrence of an alarm, and for bringing such conveyor carriage out of that region.

The device in accordance with the invention thus makes it possible to grip a conveyor carriage which is in the region of the conveyor path to be kept free, and to move it out of that region of the conveyor path with a controlled movement. This is made possible regardless of whether the travel rail in the region of the conveyor path has an ascending or descending gradient or is horizontal. This feature, advantageously, in no way limits the construction of the region of the conveyor path which is to be kept free.

The auxiliary drive is preferably arranged below and along the travel rail, which leads to a compact construction, and furthermore also permits the retrofitting of overhead conveyor systems already in use. Furthermore, the auxiliary drive can be arranged close to the center of gravity of the conveyor carriage so that no lateral forces are exerted when the auxiliary drive displaces a conveyor carriage.

By providing the auxiliary drive with an endless pull member, with pawls for engaging the carriage, a strong and reliable construction is obtained. The endless pull member makes it possible to use an inexpensive rotary drive to generate the movement of displacement. The provision of pawls has the advantage that no structural changes need be effected on the conveyor carriages. This, in turn, is advantageous for retrofitting, since conveyor carriages which are already in existence can continue to be used unchanged.

If the pull member of the auxiliary drive is arranged within the travel rail, it is possible for the travel rail to serve as a cover for repelling dirt from the gear parts of the auxiliary drive.

The auxiliary drive may advantageously be provided with an electric motor and an inexpensive independent auxiliary switching circuit which can control the auxiliary drive even in the event of a power failure.

Alternatively, a mechanical energy storage device can be provided so as to avoid any need to supply additional energy from the exterior during the operation of the auxiliary drive.

The mechanical energy storage device preferably has an electromagnetic release connected to an independent switching circuit, for independently controlling the auxiliary drive.

Preferably a support which receives the rail is provided with several differently arranged attachment points. This makes it possible for the same support to be used regardless of the course of the overhead conveyor in the region to be kept clear of conveyor carriages.

Other features and advantages of the present invention will become apparent from the following description of embodiments of the invention which refers to the accompanying drawings.

DETAILED DESCRIPTION OF EMBODIMENTS OF THE INVENTION

Embodiment 1

Figure 1:
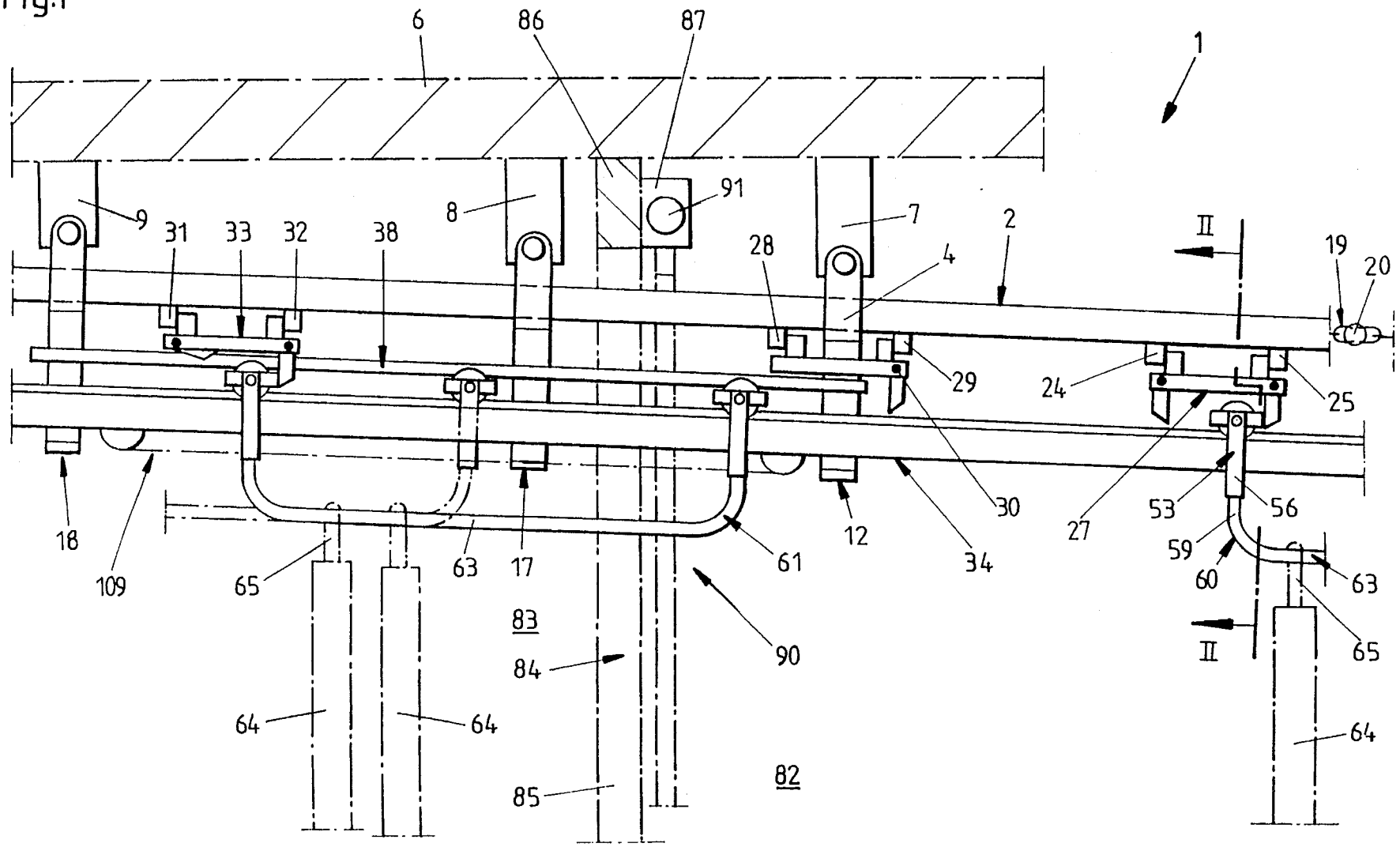
FIG. 1 is a front view of a first embodiment of an overhead conveyor.
Figure 2:
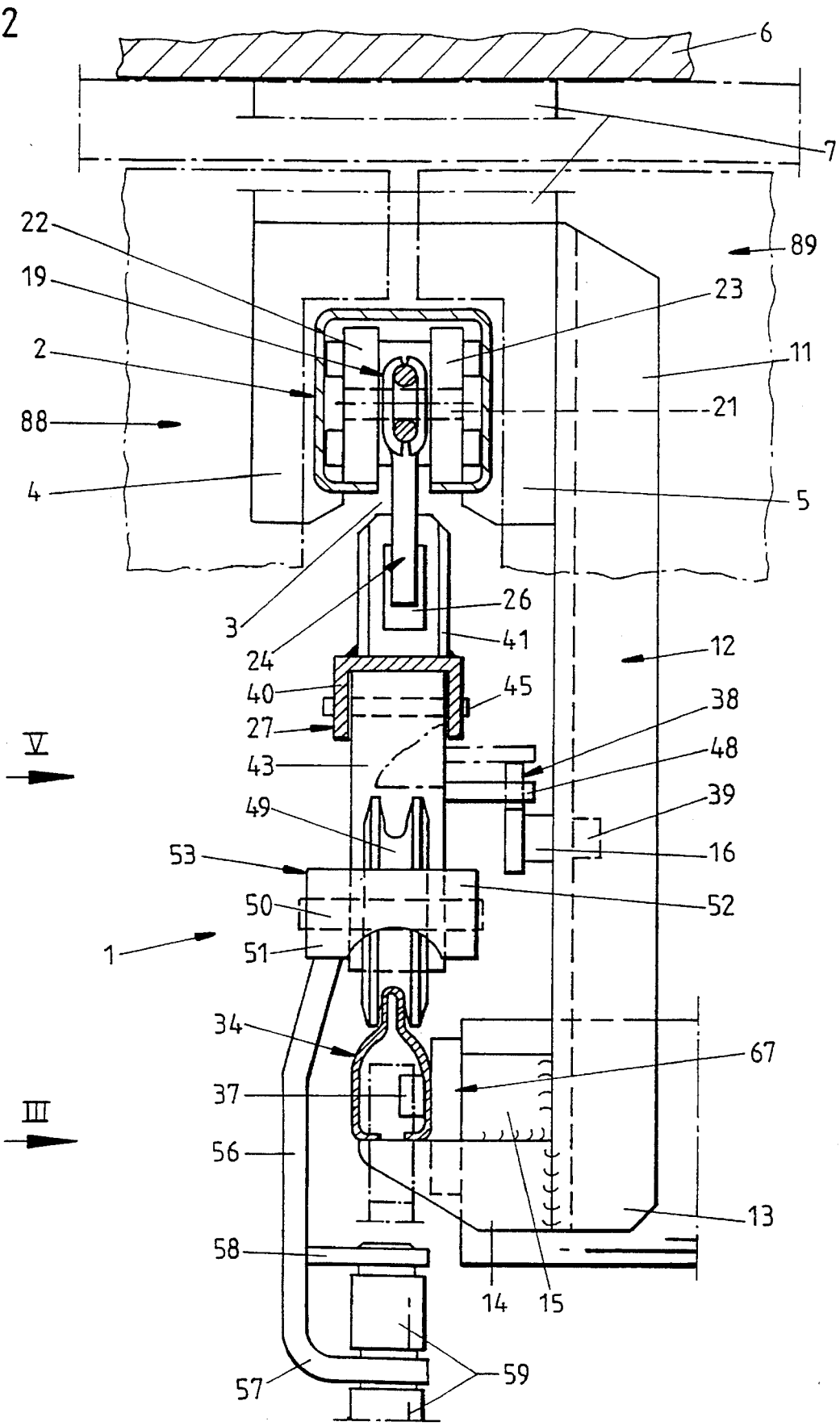
FIG. 2 is a side view of the overhead conveyor as seen along the section line II—II of FIG. 1, on a larger scale.

The overhead conveyor 1 shown in FIG. 1 has a chain channel 2 which, as shown in FIG. 2, has a cross section substantially in the shape of a square tube, including an opening 3. The chain channel 2 is fastened on holding parts 4 and 5 which are bolted to an anchor 7 which is fastened to a ceiling 6. Further anchors 8 and 9 similar to the anchor 7 are fastened to the ceiling 6, and receive the chain channel 2 via respective holding parts (not provided with reference numerals) which correspond in structure to the holding parts 4 and 5. As can be noted from FIG. 2, one end 11 of a U-shaped support 12 which is made of steel is fastened to the holding part 5. The free end 13 of the support 12 is welded to a U-shaped arm 14 which extends at right angles thereto and, in its turn, is made of steel. Furthermore, a firmly welded block 15 is present on the support 12 in the region of the point of connection of the arm 14 to the end 13. Finally, the support is also provided with an extension 16 which serves as an attachment point, which extension is welded fast. Supports 17 and 18 which correspond in their development to the support 12 are firmly bolted to the anchors 8 and 9.

Within the chain channel 2 is a pull line which in this embodiment is a conveyor chain 19. The conveyor chain 19 is connected to a main drive, such as drive motor M in FIG. 6, for being driven by the main drive. Referring again to FIGS. 1 and 2, about every third chain link 20 extending parallel to the support 12 of the conveyor chain 19 is passed through by a pin 21. Travel rollers 22 and 23 are forced onto the free ends of the pin 21. The rollers 22 and 23 may be developed as grease-sealed deep-groove ball bearings. The travel rollers 22, 23 are so dimensioned in their outside diameters that they are received with a clearance of 1 to 2 mm in the inside of the chain channel 2. As a result of their own weight and the weight of the conveyor chain 19, the travel rollers 22, 23 rest on the bottom of the chain channel 2.

As can furthermore be noted from FIG. 2, between the chain link 20 and the lateral travel rollers 22, 23 there are two plates (not designated by reference numerals) which are also passed through by the pin 21 and which are part of a support arm 24 which extends downward through the opening 3. A corresponding similar or identical support arm 25 is also arranged on the conveyor chain 19. The support arms 24 and 25 are at a given distance from each other so as to receive, movably between them, in each case via a form-locked connection as seen at 26 in FIG. 2, a driver 27 which will be described further below. Corresponding to the arrangement of the support arms 24 and 25 there are provided on the conveyor chain 19, at approximately a distance of 80 centimeters apart, another set of support arms 28, 29 for receiving an ejector 30 and support arms 31 and 32 for receiving a driver 33.

Figure 4:
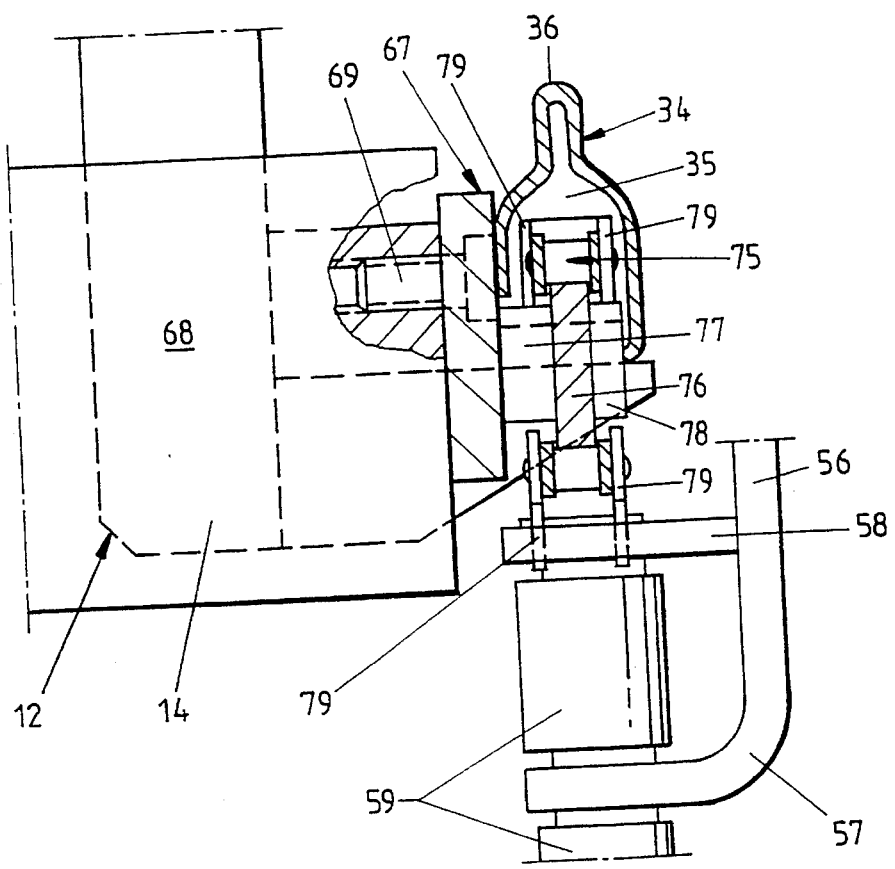
FIG. 4 is a sectional view along the section line IV—IV of FIG. 3.

As can be noted from FIG. 1, a travel rail 34 which is made of steel plate of a thickness of about 2.5 mm and has the cross-section shown in FIG. 2 is arranged on the supports 12, 17 and 18. Accordingly, the travel rail 34 is developed with an inner space 35 and a semicircular travel path 36 (FIG. 4). As shown in FIG. 2, the travel rail 34 lies on the arm 14 and is fastened to the supports 12, 17 and 18, in each case by a bolt 37, for which purpose the travel rail 34 is provided with corresponding holes (not provided with reference numerals).

Furthermore, a rail 38 is firmly bolted, in each case by bolts 39, to the extensions 16 of the supports 12, 17 and 18. The rail 38 which is of finite length and rectangular cross-section is thus invariable in position, i.e. arranged in fixed position, and thus extends parallel to the chain channel 2 and to the travel rail 34 (FIG. 1).

The construction of the identically developed drivers 27, 33 will now be described in more detail, with reference to FIGS. 2 and 5.

Each driver has a U-shaped support 40 made of metal plate on which webs 41, 42, which in each case are also U-shaped, are welded in the region of the ends of the support. Both webs 41, 42 are developed with a rectangular cutout (not provided with a reference numeral) which is part of the form-locked connection 26. Furthermore, stop pawls 43 and 44 are mounted turnably on a pin 45 near each end of the support 40 within its U-shaped cross-section. This arrangement is such that the stop pawls 43, 44, as a result of their weight, take the positions shown in solid lines in FIG. 5.

Figure 5:
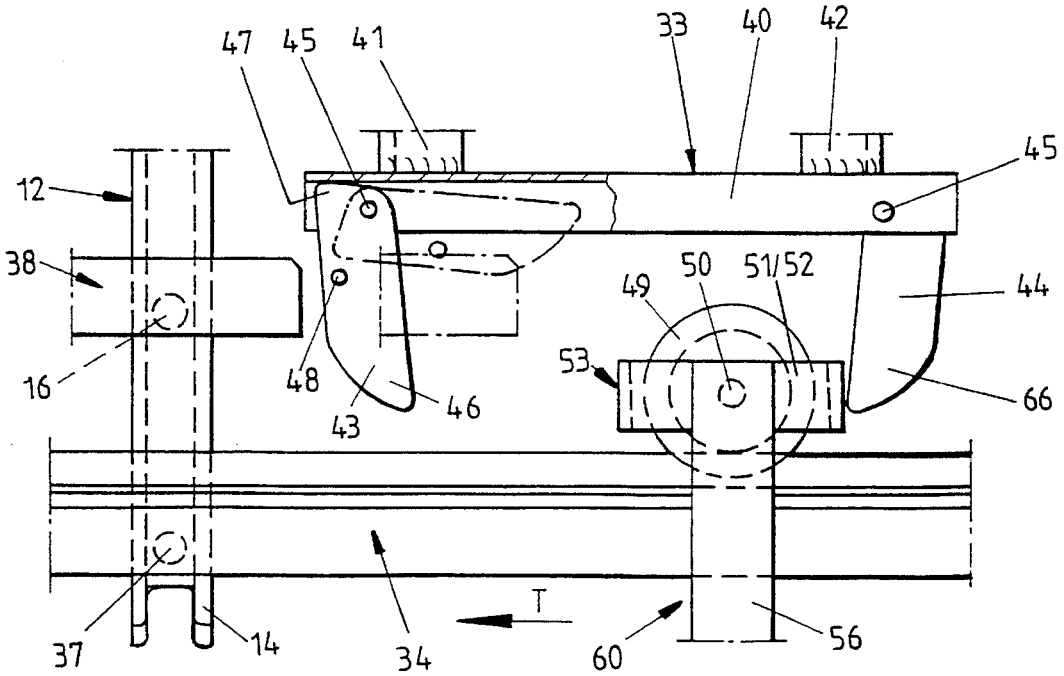
FIG. 5 shows a front view of a part of the overhead conveyor as seen in the direction of the arrow V in FIG. 2.

Referring to FIG. 5, the stop pawl 43 is developed with one end 46 which extends towards the travel rail 34 and on its other end with a cam 47 which limits the rotation of the stop pawl 43 in the clockwise direction. Accordingly, in FIG. 5, the stop pawl 43 is shown with solid lines while the dot-dash lines show a position of the stop pawl 43 after being turned in the counterclockwise direction. The stop pawl 44 has the same construction as the stop pawl 43.

The stop pawl 43 is also provided with a pin 48 which extends into the region of the rail 38. The arrangement is such that, when the pin 48 has come into engagement with the rail 38, the stop pawl 43 is swung in counterclockwise direction in such a manner that the stop pawl 43 and the rail 38 assume, with respect to each other, the positions shown in dot-dash lines in FIGS. 2 and 5.

The ejector 30 (FIG. 1) corresponds generally in its construction to the drivers 27, 33, but the ejector is provided with only one stop pawl, corresponding to stop pawl 44.

On the travel path 36 of the travel rail 34 there is received a roller 49 which is developed with a semicircular groove (not indicated by a reference numeral) corresponding to the shape of the travel path 36. The roller 49 is provided with a deep-groove ball bearing (not shown in detail) through which a pin 50 extends. The pin 50 is firmly received in cheeks 51, 52 of a roller support 53.

Figure 3:
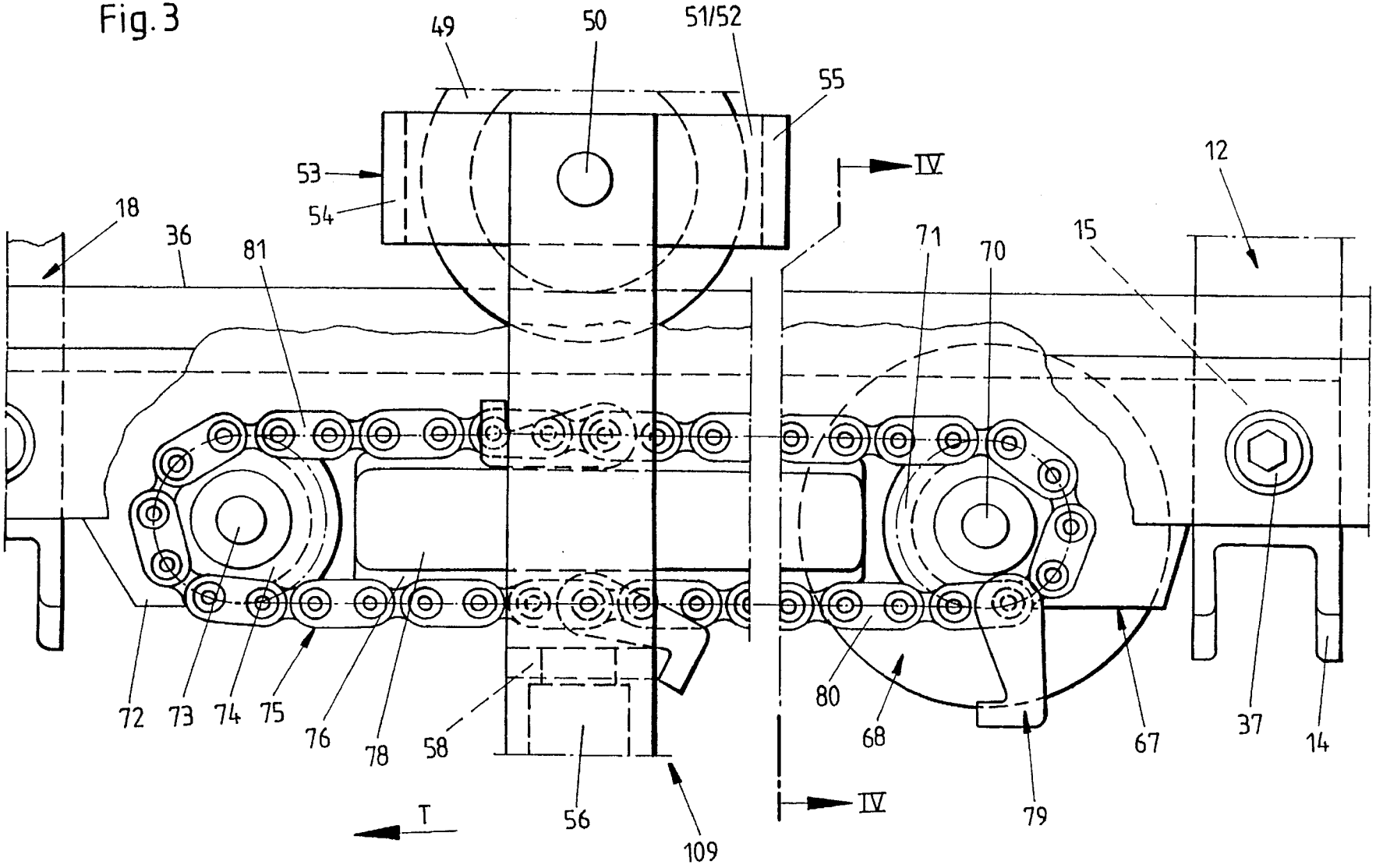
FIG. 3 shows another region of the overhead conveyor, shown on a larger scale, partially in a sectional view, as seen in the direction of the arrow III in FIG. 2.

As can be noted in particular from FIG. 3, the cheeks 51 and 52 are connected to each other by webs 54, 55 so that the cheeks 51, 52, in combination with the webs 54 and 55, surround the roller 49 in the manner of a square tube. From the roller support 53 an arm 56 extends downward, laterally spaced a distance of two to three centimeters from the travel rail 34, and the arm 56 terminates in a substantially horizontal bent-off end 57. Parallel to this end 57 a web 58 is firmly welded to the arm. In the end 57 and the web 58 there are provided aligned holes (not shown) of the same diameter, into which rotatably tapered extensions (not provided with reference numerals) of a rod 59 are received turnably, but axially fixed. The rod 59 is part of a conveyor carriage 60.

FIG. 1 shows a conveyor carriage 61 which corresponds in its construction to the conveyor carriage 60 and which, in the same way as the conveyor carriage 60, is mounted for displacement with its corresponding rollers on the travel path 36. Corresponding to the illustration of the conveyor carriage 61, the bar 59 is developed with a U-shaped cross-section, the free end of the bar 59 again terminating in an arm with a roller, corresponding to the arm 56. In accordance with FIG. 1, the bar 59 is developed with a tubular part 63 which extends parallel to the chain channel 2 and the travel rail 34 and on which material that is being conveyed, such as articles of clothing 64, is suspended by means of hangers 65.

As shown in FIGS. 1, 2 and 5, the conveyor carriages 60 and 61 are so located on the travel rail 34 that each front roller support 53, with respect to the direction of transport T, is positioned between the stop pawls 43 and 44. Due to the fact that travel rail 34 extends with a rising inclination, the roller support 53 rests via the web 55 against the end 66 of the stop pawl 44.

On the supports 12, 17 and 18 there is also fastened, by means of the bolts 37, a rectangular support ledge 67 which has the cross section shown in FIG. 2 at each of the points of attachment. In order not to clutter the drawing, the support ledge has not been shown in FIG. 1, so the following discussion will refer, in particular, to FIGS. 2, 3, and 4. On the support ledge 67 a gear motor 68 is fastened by means of bolts 69 the heads of which are countersunk in corresponding recesses in the support ledge 67 (FIG. 4). The gear motor 68 is developed with a shaft 70 on which a gear rim 71 is fastened. Furthermore, the support ledge 67 is developed at its end 72 facing the support 18 with a bearing (not further designated) within which a shaft 73 is rotatably received. On one end of the shaft 73, there is fastened a gear rim 74 which serves, in combination with the gear rim 71, to receive an endless pulling member which in this example is a roller chain 75. As can be noted from FIG. 4, the roller chain 75 is guided on a ledge 76 which is fastened, together with lateral ledge parts 77 and 78, to the support ledge 67 by bolts, not further designated. The arrangement of the ledges 76, 77, 78 is obtained by forming the travel rail 34 with recesses (not provided with reference numerals), as shown in FIG. 4, in the regions of the gear rims 71, 74. The parts just described, such as the gear motor 68, gear rims 71, 74 and the roller chain 75, together form an auxiliary drive 109, which will be described below in more detail.

Over about 40% of the circumference of the roller chain 75, a plurality of pawls are each rotatably and axially secured on chain-link bolts (not provided with reference numerals), and arranged equal distances apart, for instance, seven chain-link lengths apart, on both sides of the roller chain. This is indicated by the pawls 79 shown in different positions in FIGS. 3 and 4.

The gear motor 68 is connected electrically in such a manner that when provided with current, it turns the corresponding gear rim 71 in the clockwise direction. As soon as the pawls 79 which are turnably mounted on the roller chain 75 come into the lower course 80 of the chain, the pawls 79 hang downward as a result of their own weight. On the other hand, if the pawls are located in an upper course 81 of the chain, that is, positioned in the inside 35 of the travel rail 34, then due to the fact that they are supported from below on the ledge parts 77, 78, the pawls assume a horizontal position, as indicated by the dashed-line pawl 79 in FIG. 3. As can be noted from FIGS. 3 and 4, the structural arrangement of the web 58 with respect to the pawls 79 is such that the latter come into engagement with the web 58 when they arrive in a corresponding position, so that the conveyor carriage 61 can be driven along in the direction of transport T under certain conditions, as will be described further below.

As can be noted from FIG. 1, the ceiling 6 is common to a building room 82 and a building room 83. The two rooms 82, 83 are separated by a wall 84 within which there is a door opening 85 having a lintel 86 which delimits the top of said opening. The door opening 85 can be merely large enough for the passage of the overhead conveyor 1, including the articles of clothing 64 to be transported in the transport direction T, or can be larger, in order to also permit persons to pass through. The ceiling 6 and wall 84 including the lintel 86 may be made in the customary manner of brickwork. On the lintel 86 there is fastened a sliding door bearing 87 in which there are displaceably received a left-door half 88 and a right door half 89 (FIG. 2). The door halves 88, 89 are made of fire-resistant material and together form a fire door. The door halves 88, 89 are recessed to form an aperture which extends from the chain channel 2 down to the travel rail 34, as shown in FIG. 2. In the closed condition, the two door halves 88, 89 are located in tightly sealed fashion one in front of the other in the region between the lintel 86 and the chain channel 2 and below the travel rail 34 down to the floor (not shown) of the rooms 82, 83. The working region of the door halves 88, 89 extends through a conveyor-path region 90 which represents a part of the total conveyor path. For example, the conveyor-path region 90 can be defined by a passageway or escape path which is to be kept free of obstructions.

The arrangement of the left and right door halves 88, 89 on the door sliding bearing 87 is such that 10 both door halves 88, 89 can be closed by a door drive 91 which may be actuated by a switch pulse. The closed positions of the door halves 88 and 89 are shown in dot-dash line in FIGS. 2 and 6, while the open position of the door halves 88, 89 is shown in solid lines in FIG. 6.

Figure 6:
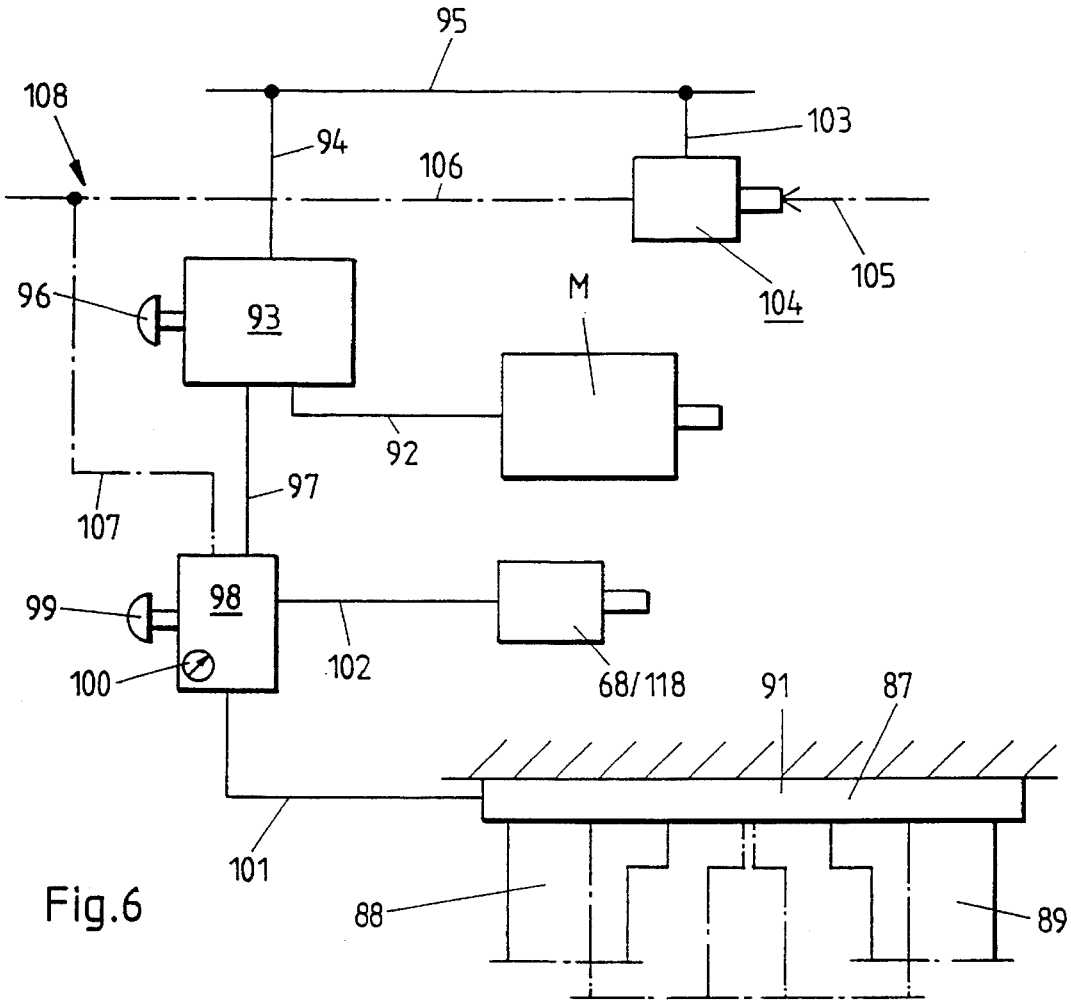
FIG. 6 is a block wiring diagram of the overhead conveyor.

The circuit connections of the individual components of the overhead conveyor 1 will now be explained (FIG. 6).

The drivel motor M is connected by a line 92 to a main control unit 93 which, in its turn, is connected by a line 94 to a power line 95. The main control unit 93 is provided with an emergency disconnect device which is indicated symbolically by an emergency disconnect button 96. Furthermore, the main control unit 93 is connected by a line 97 to a fire-alarm device 98 which has a fire alarm probe, button or detector 99 and a dial or setting device 100 for inputting a waiting time. Furthermore, the fire alarm device 98 is connected by a line 101 with the door drive 91 and by a line 102 with the gear motor 68. The power line 95 is connected by a line 103 to a control unit 104 which is connected by a line 105 to an independent auxiliary source of current (not shown). From the control unit 104, a line 106 extends which is connected via a line 107 also to the fire alarm device 98. The control unit 104 and the lines 105, 106 and 107 together from an independent switch circuit 108, as shown in dash-dot lines in FIG. 6.

The manner of operation of the overhead conveyor 1 described above is as follows:

In a starting condition, the door halves 88, 89 which separate the rooms 82, 83 are in their pulled-aside and therefore opened position, as shown by solid lines in FIG. 6. It is furthermore assumed that the conveyor system 1 is in operation, current being fed from the power line 95 to the drive motor M via the lines 92, 94 and the interposed main control unit 93. Accordingly, the conveyor chain 19 is carrying out movement in the transport direction T. As a result of the above-described connection, the drivers 27, 33 and the ejector 30 are moved in the direction of transport T, so that the conveyor carriages 60, 61 traveling on the travel rail are driven along. As already explained, due to the inclination of the travel rail 34, the conveyor carriage 60 is in contact with the stop pawl 44. That is, the end 66 of the stop pawl 44 lies against the web 55 of the conveyor carriage 60 (FIG. 5). The same applies to the conveyor carriage 61.

It is furthermore assumed that the gear motor 68 is without current and that the roller chain 75 is so positioned that all pawls 79 are disposed along the upper course 81 of the chain, the pawls 79 resting against the ledge parts 77, 78. In this starting position the lines 105 and 106 are also without current.

Upon the operation of the overhead conveyor 1, the stop pawls 43 swing up counterclockwise when the rail 38 engages the drivers 27, 33 as they pass through the conveyor-path region 90. This takes place when the pin 48 of the stop pawl 43 comes into engagement with the rail 38 which is arranged fixed in position in the conveyor-path region 90.

As soon as an emergency occurs, the entire overhead conveyor 1 can be stopped by actuation of the emergency disconnect button 96 so that the current fed over the line 92 to the drive motor M is interrupted. As soon as the emergency situation has been eliminated, the overhead conveyor 1 can again be placed in operation by switches, not shown.

In the event that after an actuation of the emergency disconnect button 96, the overhead conveyor 1 stops and, in addition, a fire alarm is also given off by actuation of the fire alarm probe 99, the following takes place: First of all, the fire alarm device 98 supplies current to the gear motor 68 over the line 102. Accordingly, the gear rim 71 turns in clockwise direction, which brings the pawls 79 around to the lower course 80 of the roller chain 75 so that they take their downward hanging position and, finally, in the manner shown in FIG. 3, come into engagement with the web 58 of any conveyor carriage 60, 61 which may be present in the conveyor-path region 90 and move it away in the transport direction T. One of the conveyor carriages 60, 61 can be driven along unimpeded since the stationary rail 38 has come into contact with the pin 48, and has thereby caused the stop pawl 43 to swing into the position shown in dotdash lines in FIG. 5 as soon as one of the drivers 27, 33 enters into the region of the rail 38. Upon the further rotation of the gear motor 68, the following roller support 53 of the conveyor carriage 61 finally also comes into the working region of the pawls 79. The latter come again into engagement with the web 58 corresponding to this roller support 53 as soon as the preceding roller support 53 has moved by means of its corresponding web 58 out of the working region of the pawls 79.

At the end of the period of time set by the dial 100, the feeding of current to the gear motor 68 is interrupted so that the pawl 79 fixes the conveyor carriage 61 in the position shown in dot-dash lines in FIG. 1 and prevents it thus from traveling backward. At this time, a conveyor carriage 61 that was present in the region of operation of the door halves 88, 89 including the articles of clothing 64 conveyed by it, has been moved out of the conveyor-path region 90 so that the door halves 88, 89 can be closed by a suitable signal, which actuates the door drive 91 via the line 101. The door halves 88, 89 close and they move towards each other, i.e. they change their position from the position shown in solid lines in FIG. 6 into the position shown in dash-dot lines.

The manner of operation of the auxiliary drive 109 described above, which drive includes the roller chain 75 provided with pawls 79 and the gear motor 68, takes place regardless of whether one of the conveyor carriages 60, 61 is within the working region of the door halves 88, 89. Thus, without requiring an additional monitoring device for the working region of the door halves 88, 89, dependable operation of the door halves 88 and 89 is obtained, so that the rooms 82, 83 are separated from each other in the event of a fire.

In the event that the entire current supply fails and thus the entire overhead conveyor 1 comes to a stop, the power line 95 is without current. This condition causes the control unit 104 to feed current coming from the auxiliary current source, for instance an emergency power supply unit or a battery, over the line 105 to the line 106. From this line 106, the electric power is furthermore distributed over the line 107 to the fire alarm device 98. If then, in addition to the failure of the power supply, an alarm is also given by actuation of the fire alarm button or detector 99, then the above-described operation of the auxiliary drive 109 is brought about, again regardless of whether one of the conveyor carriages 60, 61 is within the operating range of the door halves 88, 89.

In case of a fire alarm, the auxiliary drive 109 moves any conveyor carriage out of the conveyor-path region 90. Then, the overhead conveyor 1, after elimination of all damage caused by the emergency, must be brought back into its starting condition in which the conveyor carriages 60, 61 together with their roller supports 53 travelling in the transport direction T are again between the stop pawls 43, 44 and the left and right door halves 88, 89 are again in the open position, which assures the proper operation of the conveyor system 1.

Modified Embodiment

Figure 7:
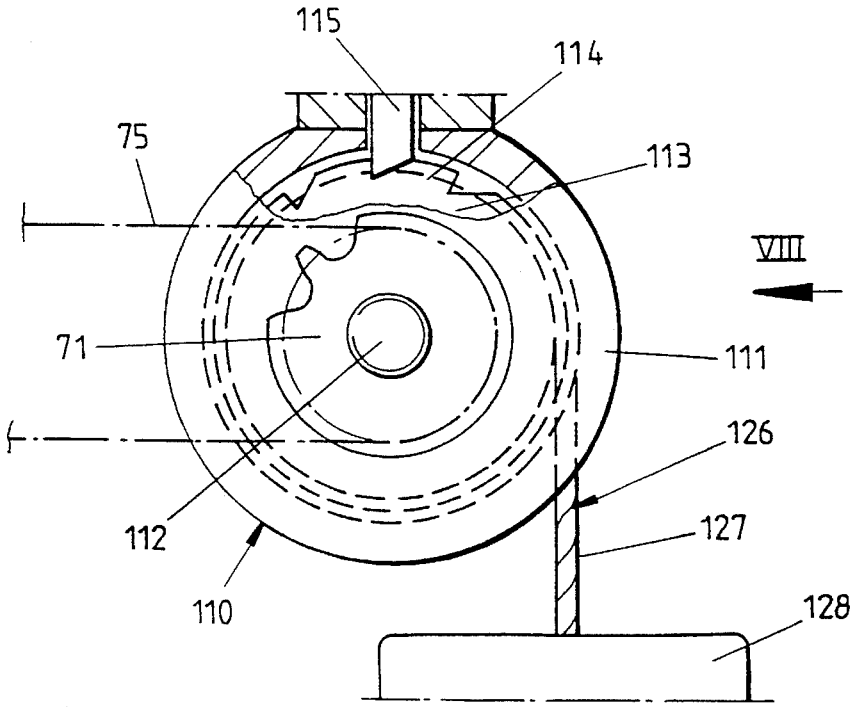
FIG. 7 is a front view of a modified assembly shown on a larger scale, as seen in the direction of the arrow III in FIG. 2.
Figure 8:
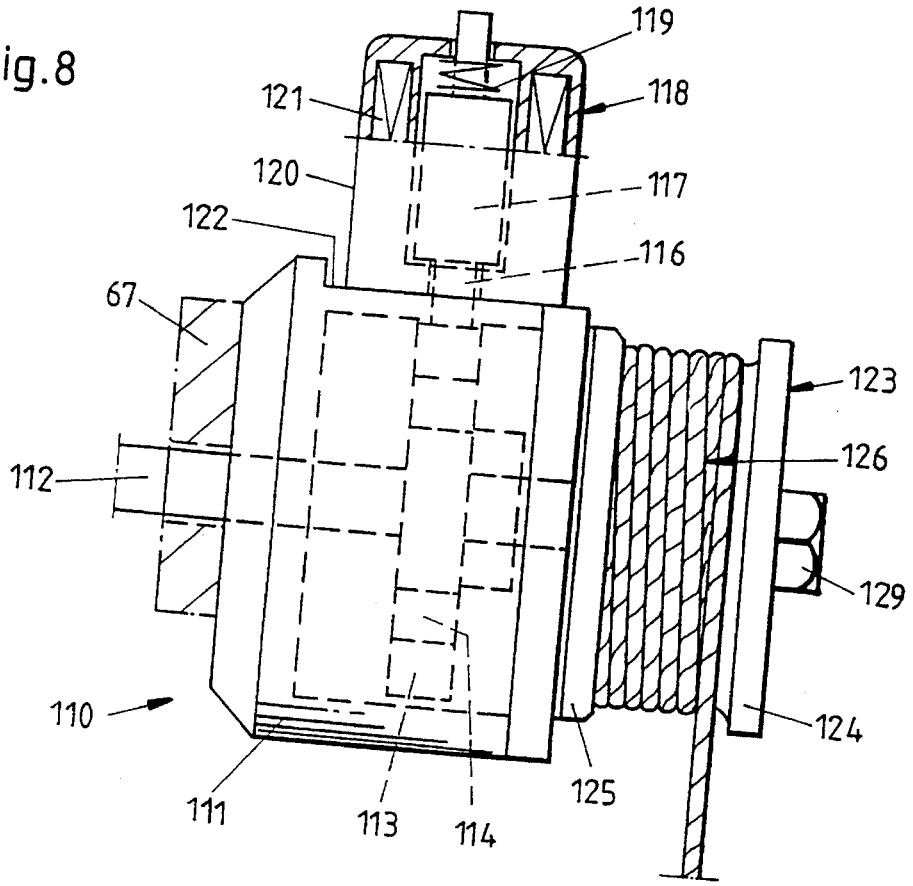
FIG. 8 is a side view of the assembly shown in FIG. 7, as seen in the direction of the arrow VIII in FIG. 7.

In a modified development shown in FIGS. 7 and 8, the auxiliary drive 109 is provided with a mechanical energy-storage drive 110 rather than with the gear motor 68. In accordance with FIGS. 7 and 8, the drive 110 has a housing 111 in which a shaft 112, corresponding to the shaft 70, is rotatably mounted for receiving the gear rim 71. The roller chain 75 is mounted on the gear rim 71 in the manner described above. Within the housing 111, there is fastened on the shaft 112 a wheel 113 which has saw-teeth 114 on its periphery. One end 115 of a slide bar 116 of square cross-section is developed corresponding to the shape of the tooth gaps formed by the teeth 114. The slide bar 116 is firmly attached to a core 117 of an electromagnet 118 which serves as a release device, the slide bar 116 including the core 117 being received displaceably against the force of a spring 119 in a housing 120 of the electromagnet 118. In customary manner, the electromagnet 118 is developed with a wire winding 121 which urges the core 117 upward when acted on by current. On the housing 111 there is a flat 122 on which the electromagnet 118 together with its housing 120 is fastened in customary manner by bolts (not shown). The housing 111 is fastened to the support ledge 67 in a manner corresponding to the gear motor 68 with bolts (not shown) corresponding to the bolts 69.

On the free end of the shaft 112 there is fastened, fixed for rotation, a drum 123 which receives between two flanges 124, 125 an amount of wound steel rope 126 having a diameter of, for instance, three millimeters. The steel, rope 126 has its one end firmly attached to the drum 123, while its free end 127 is firmly attached to a weight 128. On the side of the drum 123, the shaft is developed with an internal thread (not shown) within which a bolt 129 having a hexagonal head is firmly received.

The manner of operation of the overhead conveyor 1, which is developed with the energy-storage drive 110, corresponds essentially to the embodiment described above. In contradistinction thereto, the electromagnet 118 is controlled over the line 102, and when it releases the wheel 113, the wheel starts to turn in clockwise direction (FIG. 7) due to the action of the weight 128 present on the steel rope 126 and thus places the auxiliary drive 109 in operation for a predetermined period of time.

To place the energy-storage drive 110 in its starting condition, the steel rope 126 is again wound up in counterclockwise direction (FIG. 7) on the drum 123 by rotating the driver by means of a suitable tool for the head of the bolt 129, in which connection the end 115, due to the action of the spring 119, comes into form-locked engagement with the teeth 114 of the wheel 112 and prevents the latter from turning in clockwise direction (FIG. 7).

Embodiment 2

Figure 9:
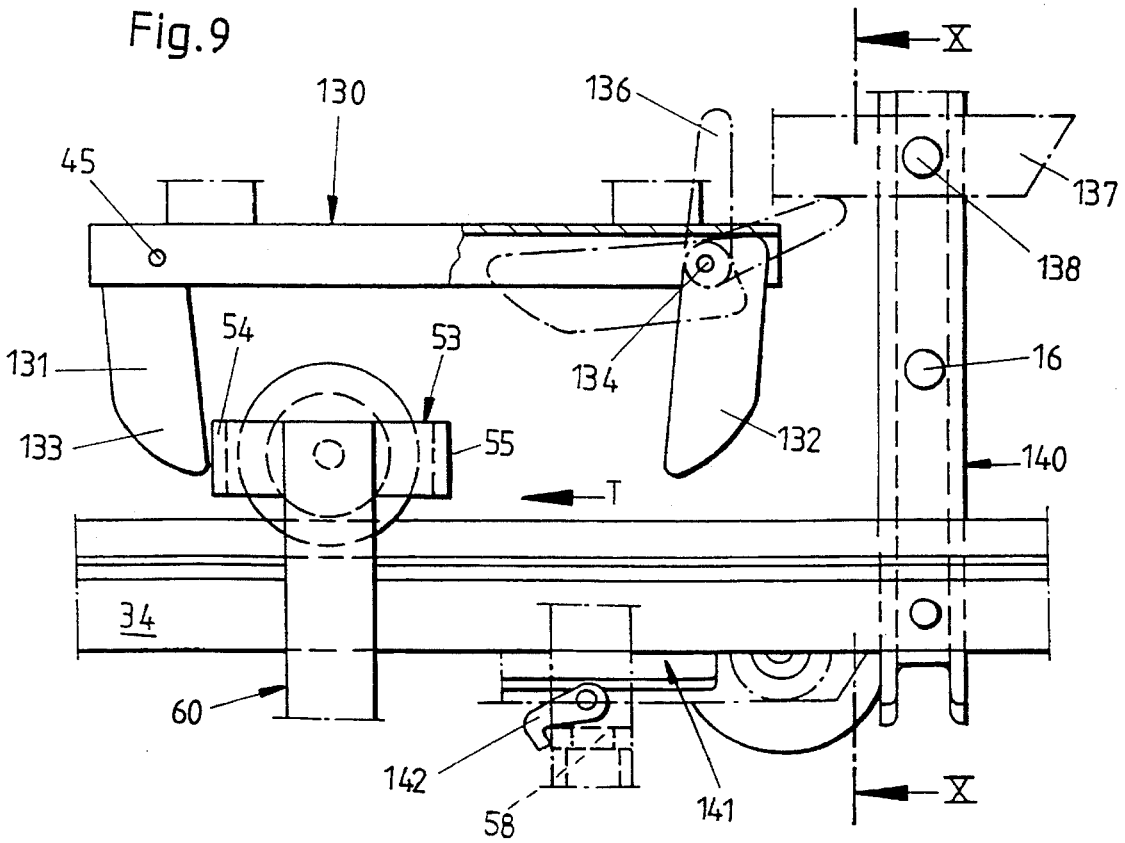
FIG. 9 is a front view of part of a second embodiment of a conveyor system.
Figure 10:
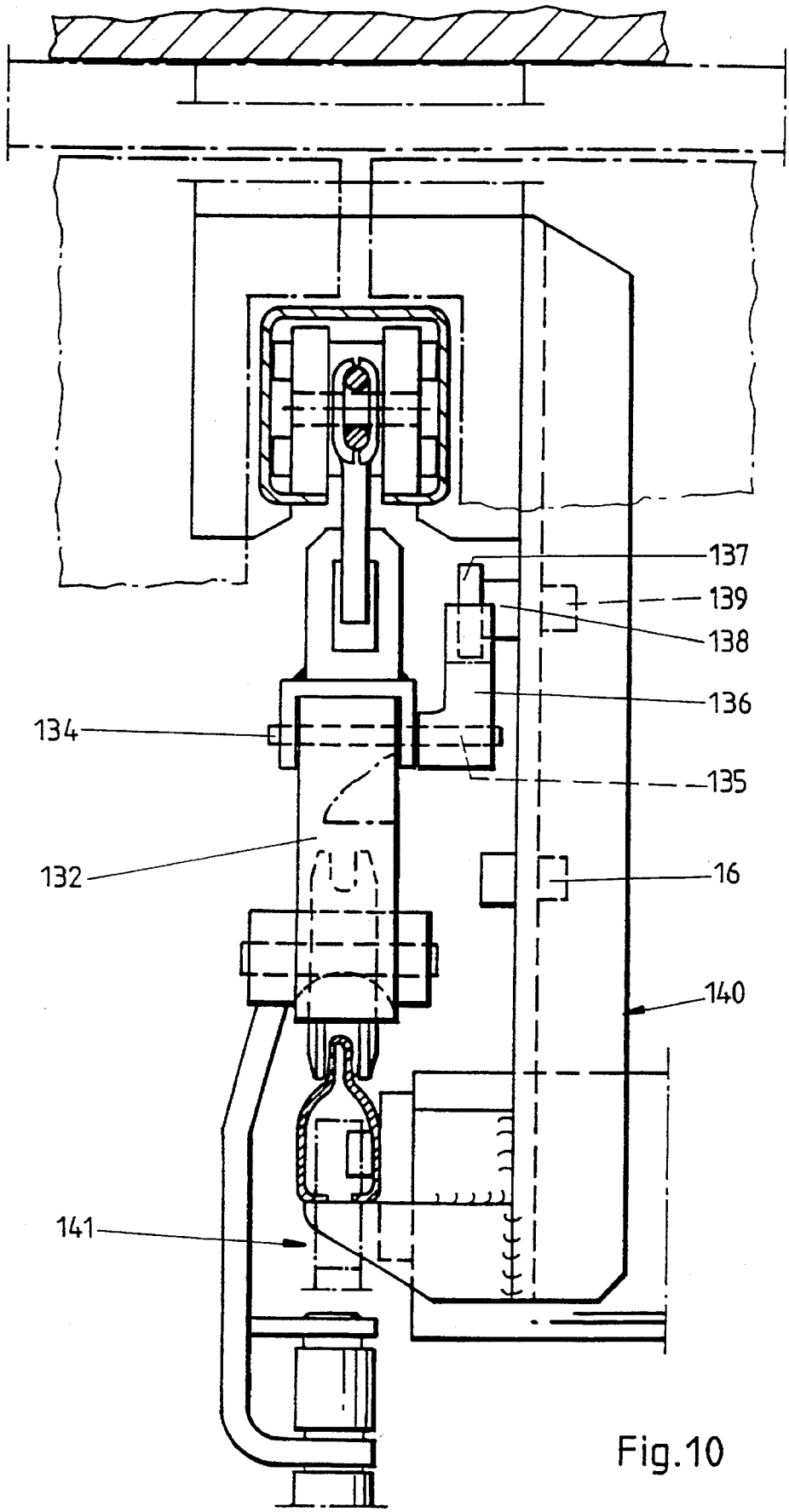
FIG. 10 is a sectional view corresponding to FIG. 2 as seen along the section line X—X in FIG. 9.

This embodiment will be described with reference to FIGS. 9 and 10. As shown in FIG. 9, the travel rail 34 is in this case downwardly inclined in the direction of transport T. Connected to the conveyor chain 19 are drivers 130, which are provided with respective stop pawls 131, 132. The stop pawl 131 is developed in the same way as the stop pawl 44 and accordingly has an end 133. The stop pawl 132 is developed in the same way as the stop pawl 131 and is firmly attached to a shaft 134 which is rotatably mounted in the U-shaped support which is similar to the support 40 in the first embodiment. On the other end 135 of the shaft 134, a lever 136 is fixed, and thereby is capable of rotating the shaft 134, and with it the stop pawl 132. The lever 136, the shaft 134, and the stop pawl 132 form a double-armed lever.

The lever 136 extends into the region of a rail 137. The rail 137 is firmly bolted to an extension 138 by means of a bolt 139, the extension 138 being a fixed part of a support 140. The support 140 corresponds in the rest of its construction to the support 12, i.e. it also has the extension 16. As a result of this advantageous feature, the support 40 can be used in both embodiments, by mounting a rail on either the extension 16 or the extension 138, depending on whether the rail is to be inclined upward or downward.

On the support 140, there is arranged in the manner described an auxiliary drive 141 with pawls, of which only one pawl 142 is shown. The auxiliary drive 141, except for the pawls, is developed in the same way as the auxiliary drive 109, the pawls being arranged in reverse position, as shown by the pawl 142. The auxiliary drive 141 can also be controlled over the line 102 in a manner corresponding to the auxiliary drive 109.

The manner of operation of the overhead Conveyor in accordance with Embodiment 2 is as follows:

Upon the operation of the overhead conveyor, the conveyor carriages 60, 61 are moved in the direction of transport T, and due to the gradient with which the travel rail 34 is arranged, they are in contact in each case via the web 54 with the end 133 of the stop pawl 131. In this way, the stop pawl 132 is in an unloaded condition. As soon as the driver 130 passes into a region of the conveyor path which is to be kept free of conveyor carriages in an emergency, the rail 137 causes a swinging of the stop pawl 132. This position is shown in dash-dot line in FIGS. 9 and 10. After an alarm is given, the drive motor M is again stopped and thereupon the auxiliary drive 141 is connected, the corresponding motor 69 being driven in counterclockwise direction (FIG. 9). In the manner described above, the pawls come into engagement with the web 58 of the conveyor carriage 60 which is to be moved out, as indicated by the pawl 142 in FIG. 9. In this way, the conveyor carriage 60 is driven along and is moved out of the conveyor-path region 90 in the direction opposite the direction of transport T. The rest of the operation corresponds to that of Embodiment 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An overhead conveyor with an arrangement for clearing conveyor carriages from a predetermined region of a travel rail in the event of an alarm, the overhead conveyor comprising:

a plurality of conveyor carriages received on said travel rail, for travelling along said travel rail;

a drivable pull line associated with said travel rail and driven by a main drive for driving said conveyor carriages;

a plurality of drivers connected to said pull line, at least one of said drivers having at least one stop pawl which has an operating position in which it is disposed for engaging the conveyor carriages travelling along said travel rail, and a non-operative position for allowing said conveyor carriages to travel along said travel rail without said stop pawl engaging said conveyor carriages;

a rail fixed in position in said region to be cleared of conveyor carriages for engaging and placing each stop pawl into its non-operating position while said driver with said stop pawl is in said region be cleared; and an auxiliary drive in said region which is selectively operable for engaging any conveyor carriage which is present in said region, and for bringing such conveyor carriage out of said region.

2. A device according to claim 1, wherein said auxiliary drive is operable for clearing said conveyor carriages out of said region while said main drive is stopped.

3. A device according to claim 1, wherein the auxiliary drive is arranged below and along the travel rail.

4. A device according to claim 3, wherein the auxiliary drive includes an endless pull member having pawls arranged thereon which can be brought into engagement with a conveyor carriage which is to be cleared from said region.

5. A device according to claim 4, wherein said auxiliary drive pawls have an inactive position in which they are disposed for not engaging the conveyor carriages in the absence of a fire alarm.

6. A device according to claim 4, wherein the auxiliary drive pull member is arranged in an inner space within the travel rail.

7. A device according to claim 3, wherein the auxiliary drive has an electric motor which is connected in controllable manner to a switch circuit which is independent of the main drive.

8. A device according to claim 1, wherein the auxiliary drive has an electric motor which is connected in controllable manner to a switch circuit which is independent of the main drive.

* * * * *